US005501616A

United States Patent [19]

Holliday

[11] Patent Number: 5,501,616

[45] Date of Patent: Mar. 26, 1996

[54] END CONNECTOR FOR COAXIAL CABLE

[76] Inventor: Randall A. Holliday, 11047 Tennyson Pl., Westminster, Colo. 80030

[21] Appl. No.: 210,480

[22] Filed: Mar. 21, 1994

[51] Int. Cl.[6] ..... H01R 17/04

[52] U.S. Cl. ..... 439/585; 439/322

[58] Field of Search ..... 439/584, 585, 439/320, 322

[56] References Cited

U.S. PATENT DOCUMENTS

| | | | |
|---|---|---|---|
| 3,355,698 | 11/1967 | Keller | 339/97 |
| 3,363,222 | 1/1968 | Karol | 339/221 |
| 3,646,502 | 2/1972 | Hutter et al. | 439/322 |
| 4,400,050 | 8/1983 | Hayward | 339/103 B |
| 4,553,806 | 11/1985 | Forney, Jr. et al. | 339/177 |
| 4,668,043 | 5/1987 | Saba et al. | 339/177 R |
| 4,684,201 | 1/1988 | Hutter | 339/177 |
| 4,755,152 | 7/1988 | Elliot et al. | 439/585 |
| 4,806,116 | 2/1989 | Ackerman | 439/304 |
| 5,073,129 | 12/1991 | Szegda | 439/578 |
| 5,083,943 | 1/1992 | Tarrant | 439/585 |
| 5,141,451 | 8/1992 | Down | 439/585 |
| 5,217,393 | 6/1993 | Del Negro et al. | 439/585 |
| 5,318,458 | 6/1994 | Thorner | 439/584 |

FOREIGN PATENT DOCUMENTS 2406417 2/1974 Germany .

*Primary Examiner*—Daniel W. Howell
*Attorney, Agent, or Firm*—John E. Reilly

[57] ABSTRACT

An end connector for coaxial cables having inner and outer spaced concentric sleeves, the outer sleeve having axially spaced endless sealing rings along its inner wall surface portion adjacent to one end to which the end of the coaxial cable is inserted, and axially spaced serrations or gripping edges are disposed on the external wall surface of the inner sleeve in confronting relation to the ribs so that when the coaxial cable is inserted into the connector with the outer conductor and jacket in the annular space between the sleeves the outer sleeve can be crimped inwardly to cause the ribs to advance into uniform sealed engagement with the jacket. The depth of the ribs can be controlled according to the diameter or size of cable to which it is connected.

14 Claims, 2 Drawing Sheets

END CONNECTOR FOR COAXIAL CABLE

BACKGROUND OF THE INVENTION

This invention relates to fittings for connecting coaxial cables to a selected device, such as, a post or terminal customarily used in cable television; and more particularly relates to a novel and improved end connector for electrically and mechanically connecting a fitting in sealed engagement with a coaxial cable.

Coaxial cables are generally characterized by being made up of inner and outer concentric conductors separated by a dielectric insulator and encased or covered by an outer jacket of rubber or rubber-like material. Numerous types of end connectors have been devised to effect a secure mechanical and electrical connection to the end of the coaxial cable and in such a way that the inner conductor and dielectric insulator extend through an inner sleeve of the connector while the outer conductor and jacket are inserted into an annular space between the inner sleeve and an outer concentric sleeve. The outer concentric sleeve is then crimped in a radial inward direction to securely clamp the end of the cable within the connector, and a fastener on the opposite end of the connector is then connected to the post or terminal. Representative of end connectors that have been devised for this purpose is that disclosed in U.S. Pat. No. 5,073,129 to Szegda which employs a combination of external ribs and internal serrations along the crimping sleeve in order to assure a reliable electrical connection and mechanical coupling between the cable and end connector. U.S. Pat. No. 4,400,050 to Hayward similarly employs a plurality of serrations along an internal surface of the crimping sleeve but which are specifically intended and designed to engage the outer conductor of the cable which is doubled over the external surface of the jacket and is concerned more with establishing firm gripping engagement with the end of the cable. Other patents of interest are U.S. Pat. Nos. 3,355,698 to Keller, 3,363,222 to Karol, 4,553,806 to Forney et al, 4,668,043 to Saba et al, 4,684,201 to Hutter, 4,755,152 to Elliot et al and 4,806,116 to Ackerman.

There is a continuing need for a one piece end connector which is capable of establishing uniform sealed engagement between the connector and coaxial cable and which is conformable for use with different sized cables but nevertheless achieves the necessary weather-tight seal as well as secure mechanical coupling between the elements while avoiding the necessity of using separate sealing members or materials.

SUMMARY OF INVENTION

An object of the present invention is to provide for a novel and improved connector fitting for coaxial cables.

It is another object of the present invention to provide for a connector fitting capable of effecting sealed engagement with one end of a coaxial cable in a novel and improved manner and in such a way as to obviate the use of separate seals or sealing compounds.

It is a further object of the present invention to provide for a novel and improved connector fitting for coaxial cables which is interchangeable for use with different diameters of cables and is deformable by crimping into uniformly sealed engagement with one end of the cable.

It is an additional object of the present invention to provide for a novel and improved connector fitting having an outer smooth crimping surface for ease of engagement and uniform clamping by a crimping tool into sealed engagement with one end of a coaxial cable; and wherein the connector fitting is conformable for use with a range of different sizes and diameters of cables.

In accordance with the present invention, an end connector has been devised for connecting an end of a coaxial cable to a terminal or post wherein the cable is a standard cable having radially inner and outer, generally cylindrical conductors separated by an annular dielectric, an outer tubular jacket of rubber or rubber-like material encasing the outer conductor and with a portion of the outer conductor being exposed at the end of the cable, the connector comprising radially inner and outer spaced coaxial sleeves, the inner sleeve being sized for insertion of the inner conductor and annular dielectric therein, the outer sleeve being sized for insertion of the outer conductor and jacket through one end of the connector between the inner and outer sleeves, at least one endless circular rib extending circumferentially around an inner wall surface portion of the outer sleeve adjacent to the one end of the outer sleeve, the rib engaging an external surface of the jacket only when the cable is fully inserted into the connector and the outer sleeve is deformed radially inwardly until the rib effects sealed engagement with the jacket, and means are provided for connecting the connector to the terminal or post.

In preferred and modified forms of the invention, a plurality of axially spaced ribs are provided adjacent to the entrance end of the outer sleeve, each rib having an inner rounded surface deformable into a portion of the jacket until the jacket occupies a circumferentially extending space between each adjacent pair of the ribs, and the inner sleeve has external projections along an external wall surface of the inner sleeve adjacent to the one end. The outer sleeve is given an external smooth surface whereby to facilitate crimping with a circular crimping tool which will uniformly reduce the diameter of the outer sleeve and cause the ribs to advance into uniform sealed engagement with the jacket. In the preferred form, the ribs are given a depth greater than one-half of the wall thickness of the outer sleeve to accommodate smaller sized coaxial cable; and in a modified form, the depth of the ribs can be reduced to less than the wall thickness of the outer sleeve in order to accommodate the larger diameter cable. Both preferred and modified forms of invention are specifically adaptable for use with a crimping tool of the type set forth in my co-pending application for patent Ser. No. 992,524, entitled "Crimping Tool" and which is specifically for use in reducing the end of the connector or fitting into a generally conical configuration snugly engaging the end of the cable as opposed to the hexagonal type of crimping tools.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
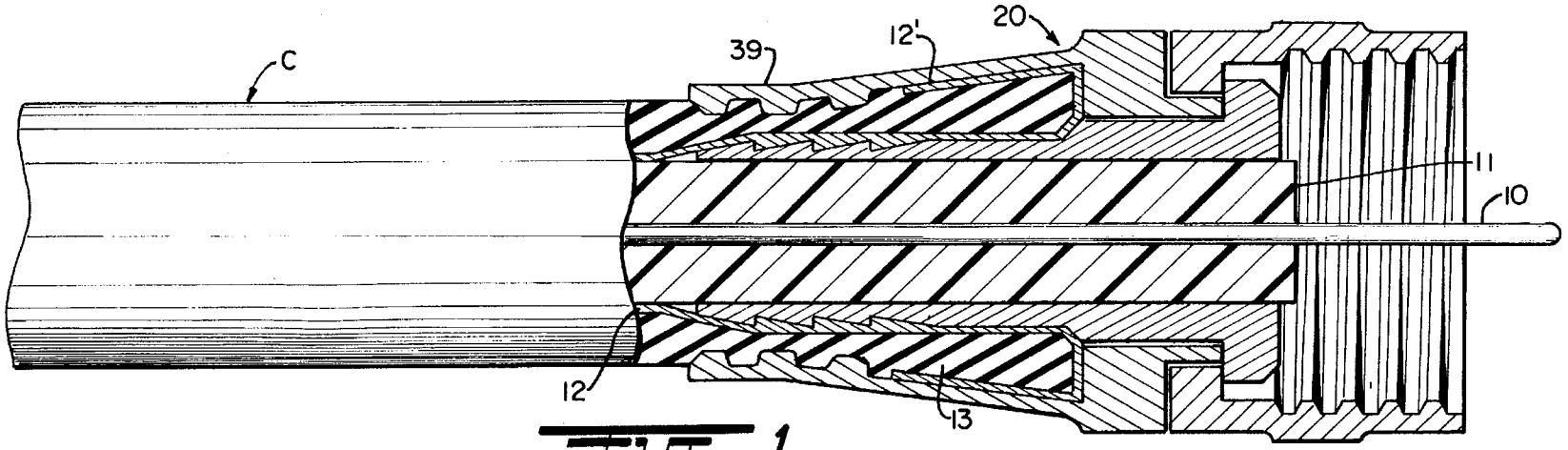
FIG. 1 is a cross-sectional view illustrating a preferred form of end connector in assembled relation to the end of a coaxial cable.

Referring now to the drawings, a conventional form of coaxial cable C is made up of an inner conductor 10, a dielectric insulator 11, outer braided conductor 12 and dielectric jacket 13 composed of rubber or rubber-like material. In accordance with well-known practice, in order to effect connection of the cable to a post or terminal, the end of the inner conductor 10 is exposed by removing a limited length of the dielectric insulator 11, and a limited length 15 of the conductor 12 is peeled back from the insulator 11 and doubled over the outer jacket 13 as designated at 12'. The standard cable C, including those used in the cable television industry, has different outer diameters, principally on account of different thicknesses employed in the outer braided conductor 12. For instance, an RG Series 59 cable may be on the order of 0.035" smaller in diameter than an RG 6 cable, and each series cable may vary approximately 0.025" owing primarily to the difference in thickness of the braided conductor layer 12.

Figure 2:
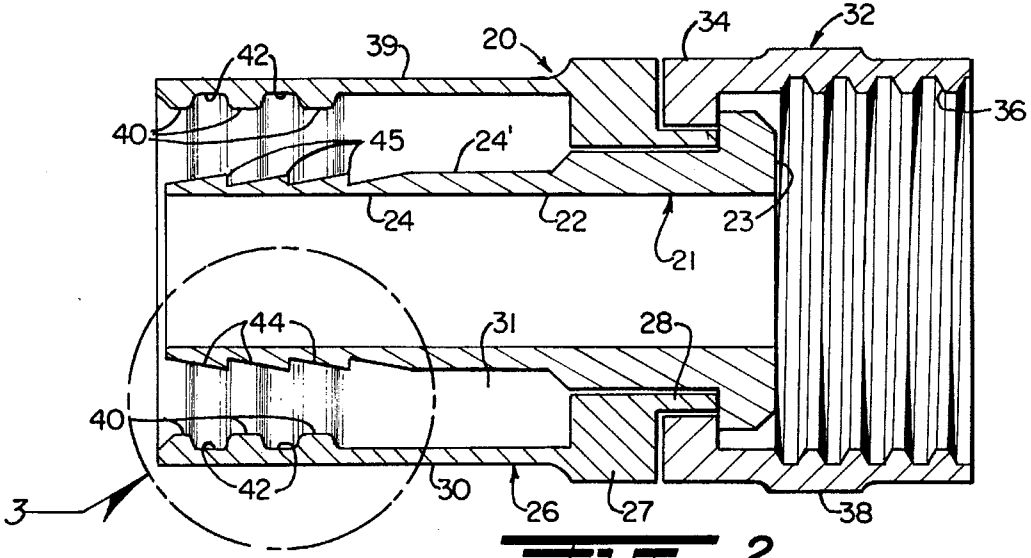
FIG. 2 is a cross-sectional view of the preferred form of end connector.
Figure 3:
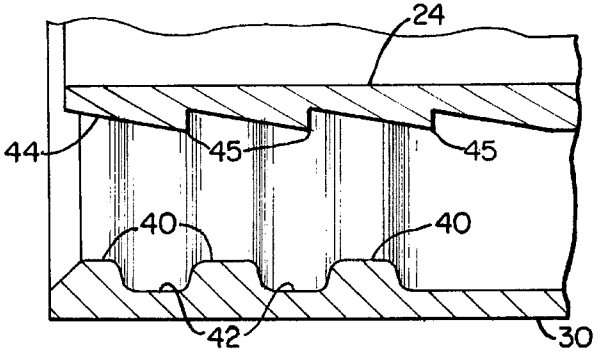
FIG. 3 is a fragmentary view enlarged taken at line 3 of FIG. 2.

In accordance with the present invention, as shown in FIGS. 1 to 3, an end connector 20 is of the type having an inner sleeve 21 including a sleeve body 22, an external shoulder or flange 23 at its forward end and a rearward extension 24 of reduced diameter and wall thickness in relation to the sleeve body 22. An outer sleeve 26 has a body 27 with an internal flange or shoulder 28 in surrounding relation to the sleeve 22 and a rearward extension 30 of reduced diameter and thickness in relation to the body 27 and in outer spaced concentric relation to the inner sleeve extension 24 so as to form an annular space 31 therebetween. External surface 39 of the extension 30 is a smooth, non-ribbed continuous surface to facilitate gripping and crimping in a manner to be described. A fastener 32 at the forward end of the end connector 20 has a radially inwardly directed flange 34 at its rearward end which is interposed between the external flange 23 of the inner sleeve and the outer sleeve body 27 and which normally is freely rotatable with respect to the inner and outer sleeve members. The fastener 32 is internally threaded as at 36 throughout its greater length and is provided with external flats 38 to facilitate engagement by a hand wrench or other tool for the purpose of threading onto an externally threaded terminal or post. When the fastener is threaded or made up onto the terminal or post, it will effectively wedge the external flange 22 of the inner sleeve against the end of the post.

An important feature of the present invention resides in the manner in which sealed engagement is established between the connector 20 and cable C. To this end, endless rings 40 extend circumferentially around inner wall surface 41 of the extension 30 adjacent to its rearward end which defines the entrance for insertion of the outer jacket. The endless ribs or protuberances 40 are disposed at uniform, axially spaced intervals so as to be define grooves 42 therebetween, the grooves 42 being of a width substantially equal to the width of the ribs 40. Further, both the ribs 40 and grooves 42 are of rounded or circular cross-sectional configuration so that when crimped inwardly in a manner to be described will cause the elastic material of the jacket 13 to fill the grooves 42 and effectively form O-rings between the jacket 13 and the rings 40. The rings 40 are formed only along the crimping zone which is that length of the rearward extension 30 adjacent to its rearward end and spaced far enough from the opposite forward end of the extension 30 as to avoid contact or engagement with the braided conductor 12.

A plurality of serrations or sawtooth edges 44 are formed on external surface 24' of the inner sleeve 24 and in facing relation to the rings 40 in order to grippingly engage the inner wall surface of the braided conductor 12. The serrations 44 are angled in a forward direction so that their apices 45 extend or face in a forward direction and will resist rearward movement of the cable C with respect to the connector 20.

In order to attach the end connector 20 onto the end of the cable C, the cable is inserted into the end connector 20 with the exposed inner conductor 10 and insulator 11 extending through the inner sleeve 21 and the outer braided conductor 12 and jacket 13 extending through the annular space 31 between the reduced rearward extension 24 of the inner sleeve 22 and the reduced outer extension 30 of the outer sleeve 26. When the cable C is fully inserted into the connector 20, the end of the jacket 13 will abut the rearward end of the flange 27 on the outer sleeve 26 and the inner conductor 10 will project slightly beyond the end of the fastener 34. Inward radial crimping of the rearward end of the extension 30 is effected by the use of a crimping tool, such as, that disclosed in my hereinbefore referred to patent application Ser. No. 992,524 and which will cause uniform, radially inward reduction in diameter of the rearward end, or crimping zone, which is that area surrounding the spaced rings 40, into uniform sealing engagement with the jacket 13. In this relation, the inner sleeve 24 extends between the outer conductor 12 and dielectric insulator 11, and the serrations 44 will be forced into firm engagement with the inner surface of the jacket 13. It is important that the outer conductor 12 be doubled over the jacket 13 for a distance short of the crimping zone as hereinbefore defined so that the rings 40 can make direct sealed engagement with the jacket.

Figure 4:
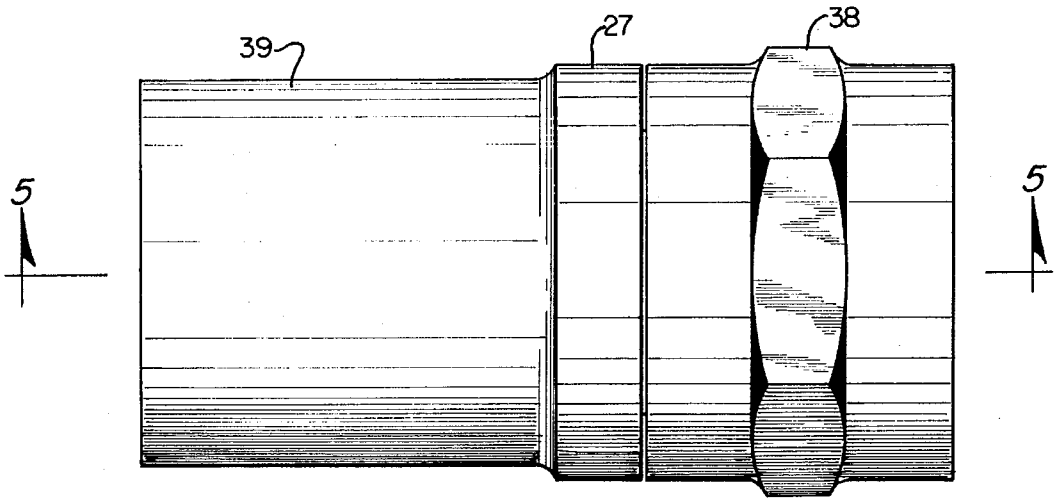
FIG. 4 is a side view in elevation of a modified form of connector.
Figure 5:
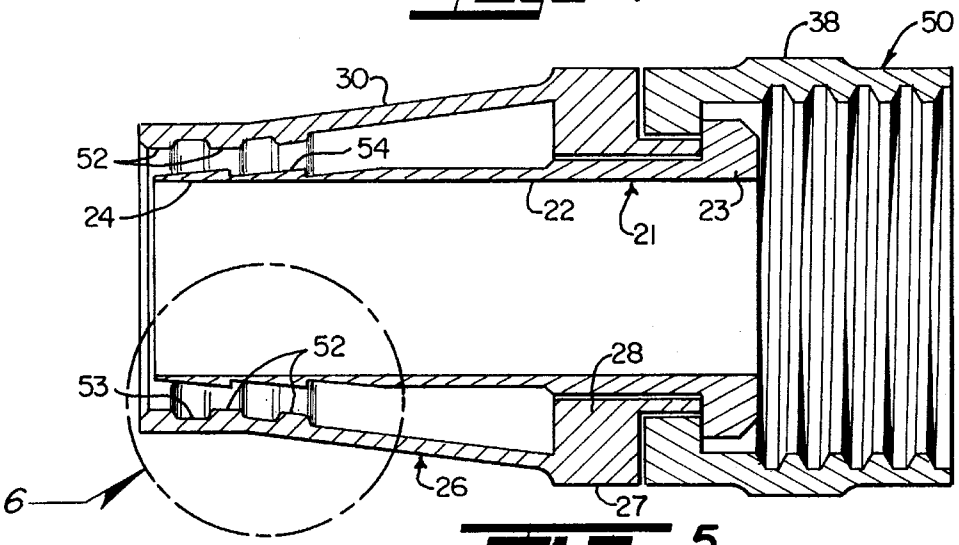
FIG. 5 is a cross-sectional view taken about lines 5—5 of FIG. 4 but illustrating the connector in a crimped condition.
Figure 6:
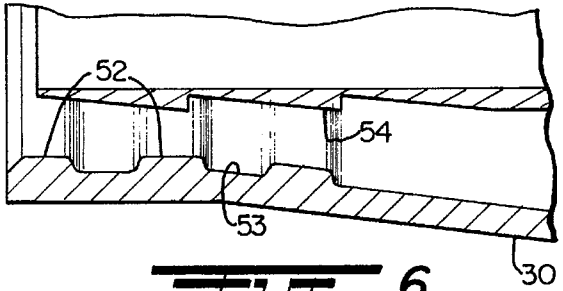
FIG. 6 is an enlarged fragmentary view taken at line 6 of FIG. 5.

The modified form of invention shown in FIGS. 4 to 6 demonstrates the universality of the end connector 10 and specifically its ability to accommodate different diameters of coaxial cables. Like parts to those of FIGS. 1 to 3 are correspondingly enumerated. The outside dimensions and make-up of the end connector 50 are the same as in the preferred form of FIGS. 1 to 3; however, in order to more easily accommodate larger diameter cable, axially spaced rings 52 along the inner wall surface of outer sleeve 30 are made shallower or truncated with respect to the deeper rings 40 of the preferred form of FIGS. 1 to 3. In addition, the external serrations 54 of the inner sleeve 24 may be formed somewhat shallower than the serrations 44 of the preferred form. For the purpose of illustration and not limitation, for an end connector having an outer sleeve 30 with an outer diameter of 0.370" and intended for use with standard RG 59 cable has sealing ribs or rings 40 with a depth on the order of 0.017". On the other hand, an end connector 50 as shown in the modified form having an outer diameter on the order of 0.370"may be given shallower sealing ribs 52 on the order of 0.004". By reducing the depth of the ribs, ample space is afforded for insertion of the thicker braided conductor 12 and outer jacket 13. The width of the grooves 53 between ribs may be the same as the width of the grooves 42 in the preferred form; and in each case the corner edges of the sealing ribs 40 and 52 are radiussed or rounded as illustrated so as not to cut or tear the outer jacket 13 of the cable.

As noted earlier, the end connectors 20 and 50 of the present invention are specifically designed for inward radial crimping along the crimping zone by means of a crimping tool which will cause uniform inward reduction in diameter of the outer sleeve so as to maintain its circular configuration as opposed to a hexagonal configuration. It is possible to achieve a greater reduction in diameter with a circular crimp than a hexagonal crimp, and the inner sealing ribs or rings 40 and 52 cooperate in assuring uniform sealed engagement with the jacket 13 of the cable.

From the foregoing, it will be appreciated that the connector 20 of the present invention is conformable for use with different-sized cables; yet, it is capable of effecting sealed engagement with the cable in the manner described without the necessity of separate seals or sealing compounds. The cable can be installed essentially in a one-step operation with the aid of a crimping tool to exert the necessary pressure on the rearward end of the extension 30 to cause the rings 40 to move into uniform sealed engagement with the outer jacket. Once connected, it is a simple matter to thread the fastener end 30 onto the post or terminal to complete the connection.

It is therefore to be understood that while preferred and modified forms of invention has been herein set forth and described, various modifications and changes may be made in the construction and arrangement of elements without departing from the spirit and scope of the present invention as defined by the appended claims.

I claim:

1. An end connector for connecting an end of a coaxial cable to a terminal wherein said cable has radially inner and outer, generally cylindrical conductors separated by an annular dielectric, an outer tubular jacket of rubber or rubber-like material encasing said outer conductor and a portion of said outer conductor being exposed at the end of said cable, said connector comprising:

(a) radially inner and outer spaced coaxial sleeves, said inner sleeve being sized to insertion of said inner conductor and said annular dielectric therein, said outer sleeve being sized for insertion of said outer conductor and said jacket through one end of said connector between said inner and outer sleeves;

(b) at least one endless circular rib extending circumferentially around an inner wall surface portion of said outer sleeve adjacent to the one end of said outer sleeve, said rib having an inner rounded surface engaging an external surface of said jacket only when said cable is fully inserted into said connector and said outer sleeve is deformed radially inwardly until said jacket occupies a circumferentially extending space adjacent to said rib; and (c) means for connecting said connector to said terminal.

2. An end connector according to claim 1, there being a plurality of axially spaced ribs, each said rib including said inner rounded surface deformable into a portion of said jacket until said jacket occupies circumferentially extending spaces between adjacent of said ribs.

3. An end connector according to claim 1, said inner sleeve having external projections along an external wall surface portion of said inner sleeve adjacent to the one end thereof.

4. An end connector according to claim 1, said outer sleeve having an external smooth surface portion of substantially uniform diameter throughout prior to crimping thereof.

5. An end connector according to claim 2, said ribs each being of a depth greater than one-half of the wall thickness of said outer sleeve.

6.An end connector according to claim 1, said said sleeves being substantially coextensive and coaxial with one another.

7. An end connector according to claim 2, said ribs and intervening spaces having rounded surfaces of generally circular cross-sectional configuration.

8. An end connector according to claim 7, said ribs and spaces therebetween being of substantially equal width.

9. An end connector for connecting an end of a coaxial cable to a terminal wherein said cable has radially inner and outer, generally cylindrical conductors separated by an annular dielectric member, an outer tubular jacket of rubber or rubber-like material encasing said outer conductor and a portion of said outer conductor being exposed and doubled over an end portion of said jacket, said connector comprising:

(a) radially inner and outer spaced sleeves substantially coextensive and coaxial with one another, said inner sleeve being sized for insertion of said inner conductor and said annular dielectric therein, said outer sleeve having an external smooth surface portion of substantially uniform diameter throughout prior to crimping thereof and being sized for insertion of said outer conductor and said jacket through one end of said fitting in an annular space between said inner and outer sleeves;

(b) a plurality of axially spaced, endless circular sealing ribs with grooves therebetween traversing an inner wall surface portion of said outer sleeve adjacent to the one end of said outer sleeve, said sealing ribs being deformable into direct engagement with said jacket in axially spaced relation to said doubled-over portion of said outer conductor when said jacket is fully inserted into an annular space between said inner and outer sleeves whereby to force external surface portions of said jacket into the grooves between said sealing ribs; and (c) means for connecting said connector to said terminal.

10. An end connector according to claim 9, said sealing ribs each including an inner rounded surface deformable into a portion of said jacket until said jacket occupies a circumferentially extending space in the grooves between adjacent of said sealing ribs.

11. An end connector according to claim 9, said inner sleeve having external projections along an external wall surface portion of said inner sleeve adjacent to the one end thereof.

12. An end connector according to claim 1, said sealing ribs each being of a depth greater than one-half of the wall thickness of said outer sleeve.

13. An end connector according to claim 1, said ribs and intervening spaces having rounded surfaces of generally circular cross-sectional configuration.

14. An end connector according to claim 13, said ribs and grooves therebetween being of substantially equal width.

* * * * *

UNITED STATES PATENT AND TRADEMARK OFFICE

CERTIFICATE OF CORRECTION

PATENT NO. : 5,501,616

DATED : March 26, 1996

INVENTOR(S) : Holliday, R.A.

It is certified that error appears in the above-indentified patent and that said Letters Patent is hereby corrected as shown below:

Claim 1, Column 5, line 38, cancel "to" and substitute --for--.
Claim 6, Column 6, line 8, cancel "said" (second occurrence).
Claim 12, Column 6, line 53, cancel "1" and substitute --10--.
Claim 13, Column 6, line 56, cancel "1" and substitute --10--.

Signed and Sealed this

Thirtieth Day of July, 1996

*Attest:*

Bruce Lehman

BRUCE LEHMAN

*Attesting Officer*

*Commissioner of Patents and Trademarks*